US006729291B1

(12) United States Patent
Scharp et al.

(10) Patent No.: US 6,729,291 B1
(45) Date of Patent: May 4, 2004

(54) MULTIPART COOLED PISTON FOR AN INTERNAL COMBUSTION ENGINE

(75) Inventors: Rainer Scharp, Waiblingen (DE); Dieter Messmer, Remseck (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/382,431

(22) Filed: Mar. 6, 2003

(30) Foreign Application Priority Data

Dec. 6, 2002 (DE) ..... 102 57 022

(51) Int. Cl.[7] ..... F02F 3/22
(52) U.S. Cl. ..... 123/193.6; 92/216
(58) Field of Search ..... 123/193.6; 92/186, 92/220, 255, 256, 258, 216

(56) References Cited

U.S. PATENT DOCUMENTS 4,375,782 A * 3/1983 Schieber ..... 92/220
4,532,686 A * 8/1985 Berchem ..... 123/193.6
4,947,805 A * 8/1990 Steppat et al. ..... 92/186
5,724,933 A * 3/1998 Silvonen et al. ..... 123/193.6
5,975,040 A * 11/1999 Silvonen et al. ..... 123/193.6
6,453,797 B1 * 9/2002 Bauer ..... 92/220
6,491,013 B1 * 12/2002 Gaiser et al. ..... 123/193.6
6,557,514 B1 * 5/2003 Gaiser ..... 123/193.6

FOREIGN PATENT DOCUMENTS

EP 0 604 223 6/1994

* cited by examiner

*Primary Examiner*—Marguerite McMahon
(74) *Attorney, Agent, or Firm*—Collard & Roe, P.C.

(57) ABSTRACT

A multipart cooled piston for an internal combustion engine comprises an upper part and a lower part of the piston. The two parts are screwed together via a threaded bolt that is arranged on the upper part of the piston, and a threaded bore that is drilled into the lower part of the piston. The threaded bore is arranged in an area of the lower part of the piston that is thin-walled to such a degree that it is deformed like a plate spring as the two parts of the piston are screwed together, so that no other safety means such as a lock nut are required for securing the assembled piston.

1 Claim, 1 Drawing Sheet

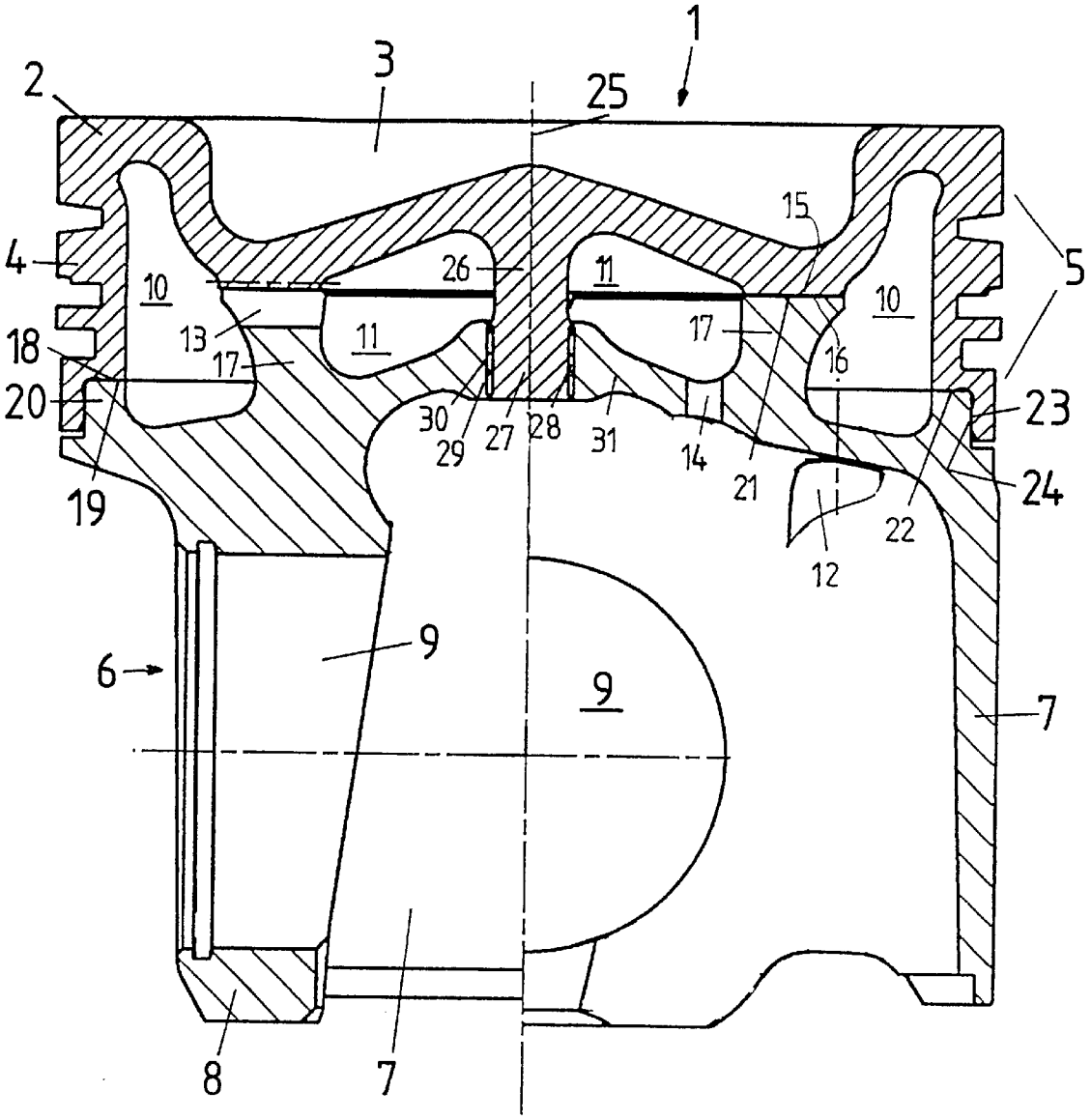
1
2
3
25
4
5
10
26
11
15
10
13
11
17
17
16
18
20
30
29
27
28
31
14
21
23
24
19
22
12
6
9
9
7
8
7

MULTIPART COOLED PISTON FOR AN INTERNAL COMBUSTION ENGINE

BACKGROUND OF THE INVENTION

1. Field of the Invention

The invention relates to a multipart cooled piston for an internal combustion engine.

2. The Prior Art

A piston used in a diesel engine is known from European patent application 0 604 223 A1 and is comprised of an upper part and a lower part. The piston is assembled by screwing the upper part of the piston to the lower part of the piston via a threaded bolt inserted in the center of the upper part, and a threaded hole drilled into the bottom part. In order to obtain a permanent joint between these two parts of the piston, it is necessary to secure the screw connection with a lock nut. This has the disadvantage that when the piston is assembled, only a short piece of the threaded bolt appears between the hubs of the bolt, so that it is difficult to screw a lock nut to this short piece of the threaded bolt.

SUMMARY OF THE INVENTION

It is therefore an object of the invention to construct the upper and bottom parts of a multi-part piston in such a manner that the upper part can be mounted on the bottom part of the piston in a simple manner without the additional use of a lock nut or any other securing means.

This object is achieved according to the invention by a multipart cooled piston comprised of an upper part and a lower part of the piston, the upper part having a ring wall and a ring part which, jointly with the lower part of the piston, forms outer ring-shaped cooling channel and also an inner ring-shaped cooling channel arranged concentrically with the outer cooling channel. The lower part of the piston comprises a box-shaped piston shaft with two bolt hubs connected therewith, whereby the upper part of the piston, on the side facing the lower part of the piston, has a threaded bolt arranged coaxially with the longitudinal axis of the piston.

The lower part of the piston, on the side facing the upper part of the piston, has a threaded bore arranged coaxially with the longitudinal axis of the piston and comprises a female thread fitting the thread of the threaded bolt. The threaded bolt and the threaded bore are arranged so that the threaded bolt can be screwed into the threaded bore for assembling the upper part of the piston and the lower part of the piston. The threaded bolt forms an inner limitation of the inner cooling channel, and an area of the lower part of the piston that covers the inner cooling channel has the threaded bore and is thin-walled to such an extent that it can be deformed like a plate spring.

What is achieved in this manner is that when the upper part of the piston is screwed to the lower part of the piston, the thin-walled area of the bottom part of the piston that is provided with the threaded drilled bore, is vaulted upwards like a plate spring, so that after the piston has been assembled, a tensile stress is exerted on the threaded bolt. This results in a permanent joint between the upper and lower parts of the piston in the assembled condition.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

The drawing shows a sectional diagram of the piston as defined by the invention. The left half of the sectional diagram represents a semi-section through the piston in the direction of the bolt, and the right half represents a semi-section through the piston in the pressure/counter-pressure direction.

DETAILED DESCRIPTION OF THE PREFERRED EMBODIMENT

Referring now in detail to the drawing, the figure shows a cooled multipart piston 1, which is comprised of an upper part 2 of the piston that has a combustion chamber 3 and a ring wall 4 with a ring part 5. A lower part 6 of the piston comprises a box-shaped piston shaft 7 and two piston hubs 8, which are connected with the piston shaft 7 and each have a bolt bore 9 for receiving a threaded bolt not shown in the drawing. Upper part 2 and lower part 6 of the piston limit an outer ring-shaped cooling channel 10 and an inner cooling channel 11 arranged concentrically in relation to the outer cooling channel. Outer cooling channel 10 has at least one inlet opening 12 for admitting the cooling oil, and is connected with inner cooling channel 11 via at least one overflow channel 13. This overflow channel 13 can be realized in the form of a bore. In this connection, there are two overflow channels 13 that oppose each other. Inner cooling channel 11 comprises at least one drain bore 14, via which the cooling oil can drain from inner cooling channel 11.

Upper part 2 is supported via a ring-shaped support surface 15 that is arranged on the upper part 2 facing away from combustion chamber 3, on an upper support surface 16 of a ring-shaped support rib 17, and via a cross-sectional surface 18 that is located on the underside of ring-shaped wall 4, on an upper cross-sectional surface 19 of a ring-shaped support bridge 20 of bottom part 6. In this connection, support surfaces 15 and 16 form an inner, plane and horizontally arranged, roof- or dish-shaped support 21, and cross-sectional surfaces 18 and 19 form an outer support 22 that is horizontally arranged coaxially with inner support 21 and shaped in the form of a roof or dish as well.

Support bridge 20 is stepped, so that via a cylinder-shaped recess 23 worked into the inner side of the lower part of ring-shaped wall 4, upper part 2 can be centered so that when the upper and lower parts of the pistons are assembled, the inner wall of cylindrical recess 23 comes into contact with cylindrical face side 24 of support bridge 20. The inside diameter of cylindrical recess 23 has to be larger than the outside diameter of cylindrical face side 24 of support bridge 20 by such a tolerance or allowance in size so that upper part 2 can be safely mounted on the lower part 6 without problems.

On the side facing away from the combustion chamber 3, upper part 2 has a bolt 26 that is arranged in the center and disposed coaxially with longitudinal axis 25 of piston 1. The end 27 of this bolt is provided with a thread 28. The area 31 between ring-shaped support rib 17 of lower part 6 of the piston, which, jointly with upper part 2 of the piston limits the inner cooling channel 11, has relatively thin walls. In its center, area 31 is provided with a bore 29 that is arranged coaxially with longitudinal axis 25 of piston 1. Bore 29 has a female thread 30 fitting thread 28 of bolt 26.

When piston 1 is assembled, only threaded bolt 26 of upper part 2 has to be screwed into threaded bore 29 of area

31. In this assembly process, the effect of the elasticity of relatively thin-walled area 31 is such that said area 31 is deformed like a plate spring as the upper and lower parts of the piston are screwed together. The inner center of area 31, which is provided with threaded bore 29, is vaulted in the direction of upper part 2 of the piston. In addition, the unthreaded expanding shaft of threaded bolt 26 is extended during the assembly process, which leads to a further improvement of the safety of the seat of upper part 2 on lower part 6 of the piston. Both support surfaces 15 and 16 of inner support 21 and cross-sectional surfaces 18 and 19 of outer support 22 are pressed against one another in this assembly process, with the effect that outer and inner cooling channels 10 and 11, respectively, are sealed.

The strength of the assembled structure comprising the upper and the lower parts of the piston is heightened further in this way to such a degree that no additional nut or lock nut is required for obtaining a permanent assembly. Tests have shown that adequate pre-tensioning of the two parts of the piston is assured under any conceivable operating conditions.

Upper part 2 of the piston may consist of an oxidation- and/or heatproof material. Typically used are steel grades with chromium contents of ≧4% selected from the material groups of the chemically resistant steel grades according to DIN EN 10027-2 (steel group numbers 1.4x xx) such as stainless, high-temperature or heat-resistant steel grades, as well as steel grades selected from the material group of the alloyed tool steel grades such as alloyed, heat-workable steel grades.

Lower part 6 preferably consists of a precipitation-hardening ferritic-perlitic steel or heat-treatable steel, whereby the steel grades 38MVS6 or 42CrMo4 are typically used (according to the German steel/iron material specification 101).

Accordingly, while only a single embodiment of the present invention has been shown and described, it is obvious that many changes and modifications may be made thereunto without departing from the spirit and scope of the invention.

List of Reference Numerals

1 Piston
2 Upper part of piston
3 Combustion chamber
4 Ring wall
5 Ring part
6 Lower part of piston
7 Piston shaft
8 Bolt hub
9 Bolt bore
10 Outer cooling channel
11 Inner cooling channel
12 Inlet opening
13 Overflow channel (bore)
14 Drain bore
15 Support surface of upper part 2 of piston
16 Support surface of lower part 6 of piston
17 Support rib
18 Cross-sectional surface of upper part 2 of piston
19 Cross-sectional surface of lower part 6 of piston
20 Support bridge
21 Inner support
22 Outer support
23 Recess of ring wall 4
24 Face side of support bridge 20
25 Longitudinal axis of piston 1
26 Bolt (threaded bolt)
27 End of bolt 26
28 Thread
29 Bore (threaded bore)
30 Female thread of bore 29
31 Area between support rib 17

What is claimed is:

1. A multipart, cooled piston for an internal combustion engine, comprising:

an upper part having a ring part and a ring wall;

a lower part, which jointly with the upper part forms an outer ring-shaped cooling channel and an inner ring-shaped cooling channel arranged concentrically with the outer cooling channel, said lower part comprising a box-shaped piston shaft with two bolt hubs connected therewith;

a threaded bolt arranged coaxially with a longitudinal axis of the piston and disposed on a side of the upper part facing the lower part, wherein the threaded bolt forms an inner limitation of the inner cooling channel; and a threaded bore arranged coaxially with the longitudinal axis of the piston and disposed on an area of the lower part that covers the inner cooling channel and which faces the upper part, said area being thin-walled to such an extent that it can be deformed like a plate spring, and said threaded bore having a female thread fitting the thread of the threaded bolt, wherein the threaded bolt and the threaded bore are arranged so that the threaded bolt is screwed into the threaded bore for assembling the upper part and the lower part.

* * * * *